US006040105A

United States Patent [19]

Nakanishi et al.

[11] Patent Number: 6,040,105

[45] Date of Patent: Mar. 21, 2000

[54] ELECTROPHOTOGRAPHIC PHOTORECEPTOR, AND A PRODUCTION METHOD OF THE SAME

[75] Inventors: Tatsuo Nakanishi, Hachioji; Shinichi Hamaguchi, Hino; Eiichi Kijima, Hachioji, all of Japan

[73] Assignee: Konica Corporation, Japan

[21] Appl. No.: 09/102,303

[22] Filed: Jun. 22, 1998

[30] Foreign Application Priority Data

Jun. 26, 1997 [JP] Japan ..... 9-170452

[51] Int. Cl.[7] ..... G03G 5/10

[52] U.S. Cl. ..... 430/127; 430/69

[58] Field of Search ..... 430/69, 127, 131

[56] References Cited

U.S. PATENT DOCUMENTS 4,011,080 3/1977 McCabe ..... 430/131

FOREIGN PATENT DOCUMENTS 510 538 10/1992 European Pat. Off. ..... 430/127
4-335355 11/1992 Japan ..... 430/127
8-044090 2/1996 Japan ..... 430/127

*Primary Examiner*—Christopher D. Rodee
*Attorney, Agent, or Firm*—Jordan B. Bierman; Bierman, Muserlian and Lucas

[57] ABSTRACT

An electrophotographic photoreceptor and a cleaning method of the support therefor are disclosed. The element of Si and Na remaining on the support surface, evaluated in terms of ESCA, has the following relation with a major element constituting the support;

$$0<[Si(surf)/Xs-Si(bulk)/Xb]\leqq 0.5$$

$$0<[Na(surf)/Xs-Na(bulk)/Xb]\leqq 0.3,$$

wherein

Si(surf): ESCA measurement (silicon) of a support surface after cleaning

Na(surf): ESCA measurement (sodium) of a support surface after cleaning

Si(bulk): ESCA measurement (silicon) of a support bulk

Na(bulk): ESCA measurement (sodium) of a support bulk

Xs: ESCA measurement (support surface after cleaning) of a major element constituting a support Xb: ESCA measurement (support bulk) of a major element constituting a support.

5 Claims, 3 Drawing Sheets

ELECTROPHOTOGRAPHIC PHOTORECEPTOR, AND A PRODUCTION METHOD OF THE SAME

FIELD OF THE INVENTION

The present invention relates to an electrophotographic photoreceptor employed for copiers, printers and the like, a production method of the same and an image-forming method using the same, and specifically, to cleaning of the support of an electrophotographic photoreceptor.

BACKGROUND OF THE INVENTION

Generally, an electrophotographic photoreceptor is a member in which a photosensitive layer is formed on an electrically conductive support of which example is in a drum-like shape. The electrically conductive drum-like support is produced by machining a cylinder of aluminum so as to result in a mirror surface or impact-forming an aluminum plate. During mirror finishing, rough surface machining, or impact-forming, the surface of the support is subjected to adhesion of cutting oil spray, ambient dust, cutting powders, etc. In order to remove these, the support surface is subjected to a cleaning process. On the support, a photosensitive layer is formed by successively coating a charge generating layer composed of a condensed polycyclic pigment, a charge generating material such as an azo pigment, etc., a binder such as resins, etc., and a charge transport layer composed of a charge transport material such as a hydrazone series or arylamine series charge transport material, resin binders, and additives such as an antioxidant, etc., and drying these layers.

The charge generating layer and the charge transport layer are formed on the surface of an electrically conductive drum-like support by coating, on the support, each of the coating compositions comprising materials composed of the above-mentioned charge generating layer and charge transport layer. Coating methods employed herein include those disclosed in, for example, Japanese Patent Publication Open to Public Inspection Nos. 49-130736, 57-5047, 59-46171, and 58-189061.

In the above-mentioned coating methods, when the surface of the electrically conductive support is not sufficiently cleaned, oil, dust, etc. remaining on the surface cause coating defects, such as repellency spots and dust spots, during coating. The defects mentioned above, formed on an electrophotographic photoreceptor, result in black spots, white spots, unevenness in intermediate image density, etc. on copied images, and consequently adversely affect image quality. The electrophotographic photoreceptor having such defects is not commercially viable.

Cleaning methods of the support surface include: dipping cleaning in which the support is dip-processed and/or dip-processed under the action of supersonic wave generally in an organic solvent, or a warmed organic solvent, if desired; contact washing in which the support is physically cleaned using a bush, a sponge, etc., under solvent showering, being immersed in a solvent; jet cleaning in which a solvent under a high pressure is ejected onto the support surface through a slit; vapor cleaning in which the support is passed through solvent vapor. Any of these methods is employed individually, or in combination, to clean the support.

Solvents employed for the above-mentioned cleaning methods, include chlorine series solvents such as methylene chloride, ethylene chloride, 1,1,1-trichloroethane, trichloroethylene, perchlorethylene, etc.; fluorine series solvents such as flon 112, flon 113, etc.; mixtures of the above-mentioned fluorine series solvent and methanol, ethanol, isopropyl alcohol or the like; petroleum based hydrocarbons, etc. and mixtures thereof. However, some of these exhibit flammability, ignitability, are toxic to the human body, have a low allowable concentration limit, or a poor cleaning capability, and thus, are not desirous.

The electrically conductive supports for the electrophotographic photoreceptor include cylindrical metal supports or thin layer sheets composed of aluminum, copper, nickel, stainless steel, brass, etc., or cylindrical supports, composed of polyester, paper or metal film, on which aluminum, tin alloy, indium oxide, or the like is spattered. Of these, aluminum is commonly employed due to low cost, ease of -machining, strength, weight, etc. Aluminum is highly reactive and soft. The more aluminum is purified, the more these properties are exhibited. In view of ease of machining and adhesion to a photosensitive layer, high purity aluminum is widely employed as an electrically conductive support material.

The cleaning the surface of the electrically conductive support composed of aluminum having such a high purity is generally carried out with an organic solvent with regard to the reactivity and softness of aluminum.

Of organic solvents, 1,1,1-trichlorethane and the like exhibit high cleaning capability and are advantageous in ease of handling, etc. However, these are considered to be one of substances which cause global warming and destruction of the ozone layer, etc. and their curtailment has been internationally decided together with flons. Accordingly, the introduction of an alternative cleaning liquid or the development of an alternative cleaning method has been highly desired.

In recent years, in order to solve the problem in employing the above-mentioned organic solvents, a method has been developed in which an electrophotographic photoreceptor is dip-cleaned, under the action of supersonic waves, with deionized water, nonionic series or anionic series surface active agent solutions, etc. (for example, Japanese Patent Publication Open to Public Inspection No. 5-61215). However, this method does not exhibit sufficient cleaning power and cannot perfectly prevent the formation of repellency spots and dust spots during coating a photosensitive layer, which are considered to be caused by insufficient cleaning.

SUMMARY OF THE INVENTION

An object of the present invention is to provide a support of an electrophotographic photoreceptor, which minimizes defects of a photoreceptor such as black spots, white spots or the like. Another object is to provide a cleaning method of an electrophotographic photoreceptor, which is easily carried out without forming pollutants, and a production method of a photoreceptor using the same, and an image-forming method using the photoreceptor and the same.

After cleaning the support surface with a cleaning agent liquid, in an electrophotographic photoreceptor in which a photosensitive layer is formed on a support surface, the cleaning agent liquid is an aqueous solution of a surface active agent comprising elements such as Si and Na, and each element of Si and Na remaining on the support surface after cleaning, when evaluated in terms of ESCA, has the following relation with a major element constituting the support.

$$0<[Si(surf)/Xs-Si(bulk)/Xb]\leqq 0.5$$

$$0<[Na(surf)/Xs-Na(bulk)/Xb]\leqq 0.3$$

Si(surf): ESCA measurement (silicon) of a support surface after cleaning

Na(surf): ESCA measurement (sodium)of a support surface after cleaning

Si(bulk): ESCA measurement (silicon) of a support bulk

Na(bulk): ESCA measurement (sodium) of a support bulk

Xs: ESCA measurement (support surface after cleaning) of a major element constituting a support Xb: ESCA measurement (support bulk) of a major element constituting a support The aqueous surface active agent solution preferably comprises an inorganic builder containing Si.

The pH is preferably between 9.5 and 13.0, and more preferably between 10.5 and 12.5.

DETAILED DESCRIPTION OF THE INVENTION

An electrophotographic photoreceptor is produced by a support cutting process, a cleaning process employing a cleaning agent (including a cleaning process employing water and a drying process) followed by a photosensitive layer coating process.

Various materials are available for the photoreceptor support. Preferred support materials are aluminum (Al), or aluminum alloys or nickel (Ni). Generally, Al series, Al—Mn series, Al—Mg series, Al—Mg—Si series alloys are often employed. Ni is employed, for example, as a nickel-plated belt and the like.

Various types of surface machining and polishing methods are available, for example, aluminum supports which undergo mirror finishing, roughening, or aluminum anodizing (pore sealing) are employed.

The major element constituting the support specifically designates aluminum, when aluminum or an aluminum alloy is employed, and Ni when Ni or a nickel alloy is employed.

In the present invention, ESCA is measured in the following way: an element ratio is calculated from element peak area intensities of silicon (Si): Si 2p, sodium (Na): Na KLL, and aluminum (Al): Al 2p measured by a Shimadzu X-ray Photoelectron Analyzer (ESCA-1000, a product of Shimadzu Seisasusho: Mgka tube) at an X-ray output of 10 kV and 30 mA. when the support surface is measured, the surface after cleaning is measured without any treatment, and when the support bulk is measured, the surface is abraded with sandpaper, etc. and the newly exposed surface is measured.

There is no limitation on compositions of the photosensitive layer, layer structures, or coating methods, of which various types are available. However, a photoreceptor is most adapted which comprises a so-called function-separated type organic photosensitive layers in which organic photosensitive materials are primarily employed; a charge transport function and a charge generating function are shared by different compounds and each of the compounds is incorporated in a separate layer.

Examples of the support cleaning are described.

Figure 1:
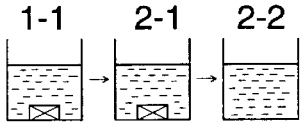
FIGS. 1(*a*) to 1(*g*) are schematic views showing the cleaning and rinsing of supports with different numbers of tanks.
Figure 1:
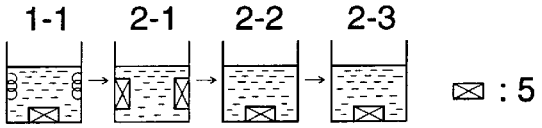
Figure 1:
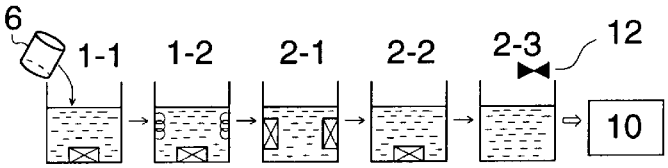
Figure 1:
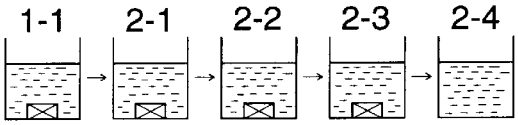
Figure 1:
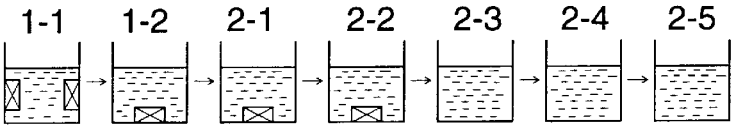
Figure 1:
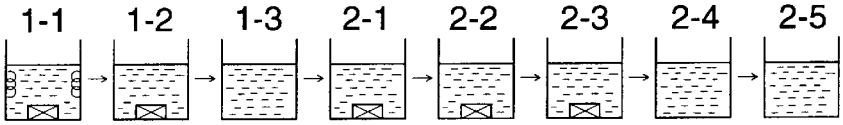
Figure 1:
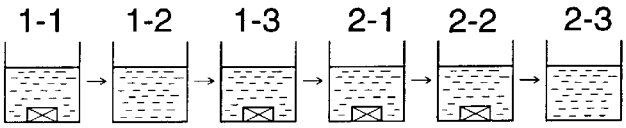

A photoreceptor support made of aluminum is cleaned, which is formed to the desired diameter; cut to specified dimensions and undergoes surface finishing such as machining, etc. A cleaning vessel is generally separated into 3 to 10 sections. FIGS. 1(*a*) to 1(*g*) shows schematic views.

With reference to, for example, FIG. 1(*c*), a more specific description is provided. A first tank 1-1 comprises a 0.1 to 30% cleaning agent solution (occasionally referred to as a cleaning agent liquid) generally at temperatures of 10 to 60° C. and in the tank, a supersonic cleaning device is installed. A second tank 1-2 has a similar composition. Dirt such as metal powders, oils, etc. attached to the surface of the photoreceptor support during cutting are mostly cleaned in the first tank and are perfectly cleaned in the second tank. The processing time in each tank is generally 1 to 30 minutes and supersonic waves are uniformly exposed. Furthermore, in the tank, the support may be rotated and/or moved upward and downward. In FIG. 1(*a*)–1(*g*), 1-1, 1-2, and 1-3 each represents a cleaning agent solution tank and 2-1 to 2-5 each represents a water washing tank.

Components of the cleaning solution include the following. The mixtures may be employed.

Nonionic surface active agents include polyoxyethylene ethers and sorbitan alkyl esters. For example, alkylpolyoxyethylene ether type such as $RO(C_2H_4O)H$, etc. and polyoxyethylene block copolymer type (plulonic type, R represents a saturated or unsaturated alkyl group having 4 to 25 carbon atoms) having a structure of $RO(C_2H_4O)_m(C_3H_6O)_nH$, are representative. The HLB of these nonionic surface active agents is between 5 and 15, and preferably between 7 and 14.

Anionic surface active agents include higher alcoholsulfonate ester salts and fatty acid amidosulfonate salts. The representative examples are straight chain alkylbenzenesulfonate sodium salts.

Amphoteric surface active agents include an imidazoline derivative type, a betaine higher alkylaminocarboxylic acid type, and alkylcarboxybetaine type (an alkyl part is a saturated or unsaturated alkyl group having 8 to 22 carbon atoms) like N-alkyldimethylbetaine shown as the following (A) and (B) and an alkylaminocarboxylic acid type (an alkyl part is the same as that in (A) and an alkylimidazoline type like N-alkylaminopropionate salt shown as (C).

(A)

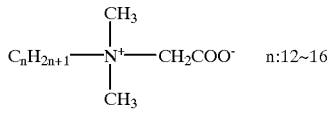

(B)

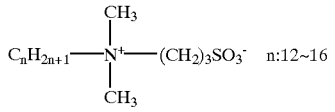

(C)

Inorganic builders are cleaning aids, and silicate salts comprising Si such as sodium orthosilicate and sodium metasilicate are employed. Of these, sodium metasilicate is preferred.

Cleaning agents, in many cases, comprise chelate agents such as sodium nitrilotriacetate (NTA-Na salt $N(CHCOONa)_3$). However, the addition is optional.

As additives to the cleaning agent, for improvement in liquid stability and cleaning properties, added may be sodium gluconate salts, sodium citrate salts, sodium p-ethylbenzenesulfonate salts, sodium xylenesulfonate salts or the like.

The initial pH of both the first tank (1-1) and the second tank (1-2) is generally between 12 and 12.5, and the pH may not be higher than 13.0. It is not required to raise the pH to a value higher than that to exhibit the cleaning properties. As cleaning proceeds, the pH tends to decrease, if not controlled. When the pH decreases to not higher than 9.5, the activity of the solution decreases. Accordingly, the pH is preferably controlled to no less than 9.5 by the addition of appropriate alkali agents or weak acids and strong alkali salts.

In FIG. 1(*c*), it is recommended to constitute a flow in such a way that processes performed in a third tank, a fourth tank, and a fifth tank (2-1, 2-2, and 2-3) are mainly of washing the cleaning agent and etc. employed in the first and second tanks; deionized water is put into a fifth tank (2-3); the overflow from the fifth tank is put into the fourth tank; the overflow from the fourth tank is put into the third tank, and the overflow from the third tank is abandoned.

The deionized water employed herein is deionized water having a resistance of $0.01\times10^6$ to $18\times10^6$ Ω· cm and the deionized water put into the fifth tank naturally has a higher resistance and water having a resistance of about $15\times10^6$ Ω· cm is employed.

The third and fourth tanks are maintained at 25 to 30° C. and equipped with a supersonic wave generator 5. The fifth tank may not be equipped with the supersonic generator. Alternatively, it is preferred to raise the temperature of the fifth tank to a fairly high range of about 40 to about 60° C. The processing time is generally between 1 to 30 minutes and it is preferred to move upward and downward the support, while being rotated. Further the supersonic wave generator employed for cleaning is operated at a frequency of 25 to 60 kHz.

For conveyance of the photoreceptor support 6 from the first tank to the fifth tank, as a mechanism to dip the support, non-scheduled replacement chuck utilizing three claws and automatically scheduled replacement palette utilizing three claws may be employed. In the second tank, scrub cleaning may be conducted employing a fixed brush in the liquid. Furthermore, in the fifth tank, when the support is finally removed from the cleaning device, an air knife 12 is preferably installed in order to remove the adhered tank liquid as much as possible. The support leaving the fifth tank is dried at about 80 to about 150° C. for 3 to 60 minutes in drying chamber 10 employing cleaned air, and this completes the cleaning processes. The constitution of these processes are nearly the same as for other constitutions (*a*), (*b*), (*d*) to (*g*) in FIG. 1.

A preferred system is that each tank is equipped with a circulation channel and a pump, and the circulation channel is equipped with a filter to remove insoluble matter.

In the present invention, cleaning properties are remarkably improved with the incorporation of an inorganic builder comprising Si such as, for example, sodium metasilicate and sodium orthosilicate in an aqueous surface active agent solution. On the contrary, it is found that the load during the rinsing step tends to increase. This is mainly caused by the adhesion action of the inorganic builder onto the support surface and it has been found that Si and Na remaining on the support surface after cleaning, affect the quality of an electrophotographic photoreceptor.

When values of elements Si and Na remaining on the support surface after cleaning, in terms of ESCA evaluation, are not more than 0.5 and 0.3 (value of Si(surf)/Xs−Si(bulk)/Xb and Na(surf)/Xs−Na(bulk)/Xb], respectively) of the major element constituting the support, no practical effect is found on image quality and photoreceptor properties. However, when the amount is larger than the above-mentioned values, adverse effects such as image background density increase, unevenness of image density, instability of electric potential properties are caused. It is considered that a charge is liable to be injected from the support onto the photosensitive layer due to the remaining Si and Na. Further, the values are more preferably not more than 0.3 and 0.1.

A method to adjust values of the Si and Na elements remaining on the support surface after cleaning to Si(surf)/Xs−Si(bulk)/Xb≦0.5 and Na(surf)/Xs−Na(bulk)/Xb≦0.3, respectively, in terms of the ESCA evaluation, is not generally described because it depends on the composition of cleaning agents and rinsing conditions, etc. However, it is accomplished by preventing drying of the aqueous surface active agent solution prior to rinsing through controlling the conveyance time from the aqueous surface active solution tank to the rinsing tank within 5 minutes. Conveyance time of more than 5 minutes is possible, depending on the concentration of the aqueous surface active agent solution, the temperature of the solution, and moreover, the ambient humidity during the conveyance. However, the conveyance time is preferably managed within 5 minutes to limit productivity decreases.

A photosensitive layer is formed on the surface of the electrically conductive support employing a method known in the art. For example, a charge generating layer is formed on the surface of the electrically conductive support employing any of an dip-coating method, a ring system coating method, a spray coating method or a circular volume regulating type coating method followed by forming a charge transport layer on the charge generating layer employing an dip-coating method or a spray coating method.

It has been found that the photoreceptor employing a photoreceptor support cleaned as mentioned above results in no formation of image background density, black spots, white spots, etc. and the cleaning solution waste is markedly non-polluting.

A subbing layer is occasionally provided in order to improve the adhesion properties and coating properties of the photosensitive layer, to cover defects on the support, to improve charge injection properties to the charge generating layer and the like. Materials, employed for the subbing layer, are polyamide, copolymer nylon, casein, polyvinyl alcohol, cellulose, gelatin, etc. These are dissolved in various organic solvents and coated on the electrically conductive cylindrical support so as to form a layer thickness of about 0.01 to about 5 μm.

The charge generating layer is composed of, as a main component, a charge generating material which generates electric charges by light irradiation, binders, plasticizers, sensitizers, as desired, which are generally coated on the electrically conductive support or the subbing layer so as to form a layer thickness (dried layer thickness) of not more than 1.0 μm.

Charge generating materials include perylene series pigments, polycyclic quinone series pigments, phthalocyanine pigments, metal phthalocyanine series pigment, squarium dyes, azulenium dyes, thiapyrylium dyes, and azo pigments having a carbazole skeleton, a styrylstilbene skeleton, a triphenylamine skeleton, a dibenzothiophene skeleton, oxadiazole skeleton, a fluorenone skeleton, a bis-stilbene skeleton, a distyryloxadiazole skeleton, or distyrylcarbazole skeleton, and the like.

The charge transport layer is composed of, as essential components, a charge transport material capable of receiving a charge generated by the charge generating material and transporting it, and a binder, and, if desired, leveling agents, plasticizers, sensitizers, etc. well known in the art, and is generally coated on the charge generating layer so as to form a dried layer thickness of 5 to 70 $\mu$m.

Charge transport materials include electron donating substances such as poly-N-vinylcarbazole and derivatives thereof, poly-g-carbazolylethylglutamate and derivatives thereof, pyrene-formaldehye condensate and derivatives thereof, polyvinylpyrene, polyvinylphenanthrene, oxazole derivatives, imidazole derivatives, 9-(p-diethylaminostyryl) anthracene, 1,1-bis(4-dibenzylaminophenyl)propane, styrylanthracene, styrylpyrazoline, phenylhydrazones, hydrazone derivatives, etc., or electron accepting materials such as fluorenone derivatives, dibenzothiophene derivatives, indenothiophene derivatives, phenanthrenequinone derivatives, indenopyridine derivatives, thioxanthone derivatives, phenazineoxide derivatives, tetracyanoethylene, tetracyanoquinodimethane, promanyl, chloranyl, benzoquinoe, etc.

As binders constituting the charge transport layer, those which are compatible with the charge transport material may be employed. Listed, for example, are polycarbonate, polyvinylbutyral, polyamide, polyester, polyketone, epoxy resins, polyurethane, polyvinylketone, polystyrene, polyacrylamide, phenol resins, phenoxy resins, etc.

The electrophotographic photoreceptor produced by the method of the present invention causes almost no black spots nor white spots in images due to repellency spots, dust spots, etc. and results in high yield of high quality images. Furthermore, because no organic solvent is employed in the cleaning process, there is no air pollution due to the usage of organic solvents, no toxic effect on the human body and no danger of explosion due to high flammability and ignitability.

In the following, the image-forming process is described with reference to FIG. 2, in which one example of a digital copier employing the above-mentioned image-forming method is shown. However, the present invention is not limited to this example.

As mentioned above, the image-forming process of the present invention exhibits advantages particularly in the image-forming method, including reversal development in digital copiers etc.

Figure 2:
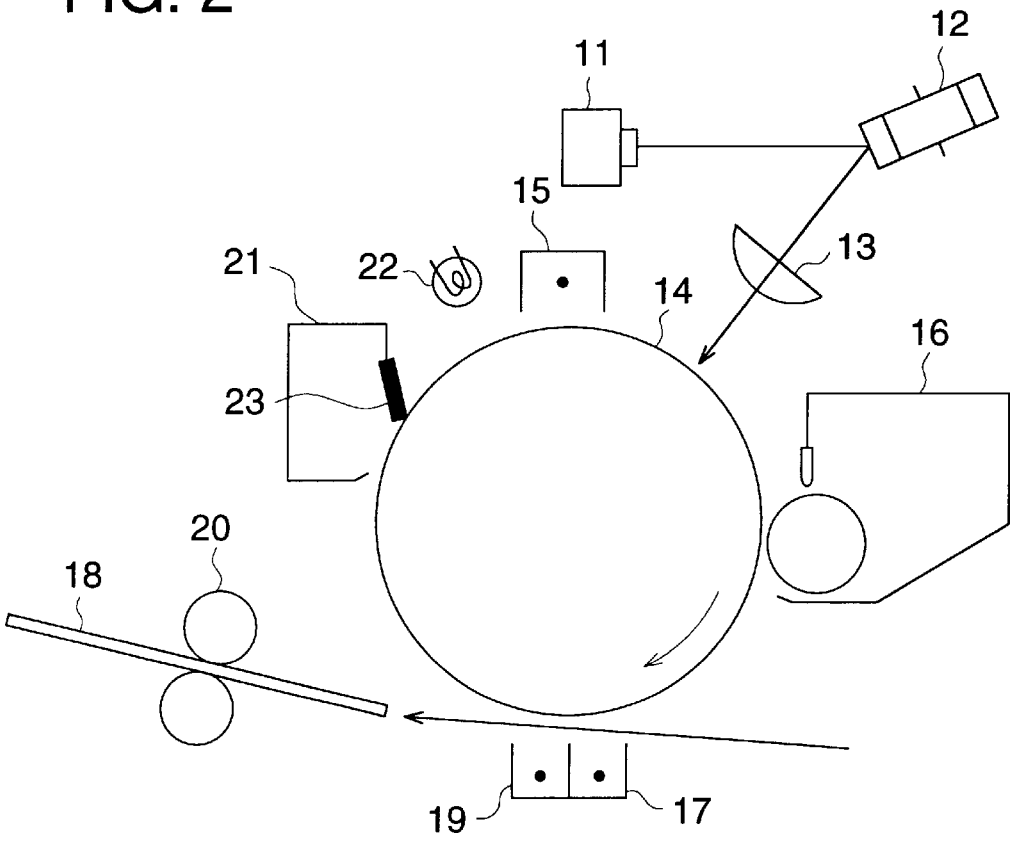
FIG. 2 is a schematic sectional view illustrating one example of the image forming apparatus of the present invention.

In the image-forming apparatus in FIG. 2, light is emitted to an original from a light source, though not shown in the figure, and the reflected light is converted to electric signals in an image reading section, and the image data are transmitted to an image writing sections 11 to 3 (11 is a laser beam source, 12 is a polygon mirror, and 13 is an fq lens.).

On the other hand, a photoreceptor drum 14 performing image-formation is uniformly charged with corona discharging employing a charging unit 15 and image exposure light is then irradiated onto the photoreceptor drum from the laser beam source 11 in the image writing section. Thereafter, reversal development is carried out in a development unit 16 which follows and the resulting image is transferred to a recording sheet (recording material) employing a transfer electrode 17. The recording sheet 18 is separated from the photoreceptor drum employing a separation electrode 19 and fixed by a fixing device 20. On the other hand, the photoreceptor drum 14 is cleaned by a cleaning device 21. Further, 22 is an exposure lamp used prior to charging and may be provided after the separation electrode 19 and before the cleaning device 21.

After a toner image is transferred onto a recording material, the toner remaining on the photoreceptor is removed with cleaning and the photoreceptor is repeatedly employed for next successive processes.

In the present invention, a cleaning mechanism is preferably a cleaning system employing a so-called brush roller and elastic rubber blade. Numeral 23 in FIG. 2 is an elastic rubber blade.

As materials constituting the elastic rubber blade, elastic materials such as silicone rubber, urethane rubber, etc. may be employed.

The process described above employs a single color. However, the present invention is preferably employed for color image formation employing a plurality of colors. A color image, when read, undergoes color separation and a signal of each separated color is employed for forming the separated color image through charging, image writing with laser beam exposure, and development with the corresponding color toner; then this process is repeated, four color toner images composed of yellow, magenta, cyan, and black are superimposed on the photoreceptor and are simultaneously transferred to a recording sheet.

Furthermore, the photoreceptor of the present invention exhibits advantages particularly in the image-forming method including reversal development which is susceptible to defects such as an increase of image background density, black spots, etc., in printers, digital copiers, etc.

Figure 3:
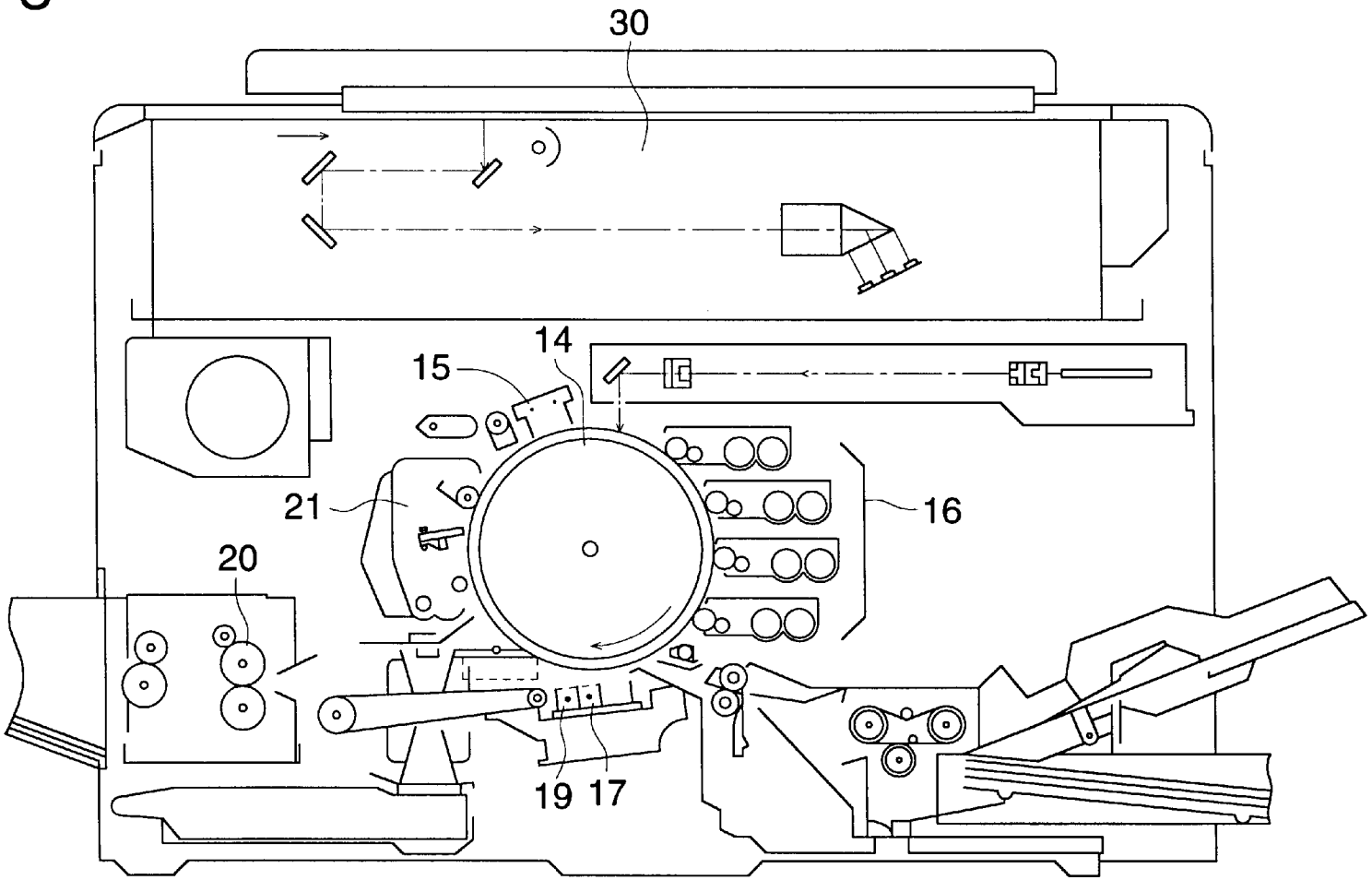
FIG. 3 is a schematic sectional view illustrating one example of a digital copier employing the image-forming method of the present invention.

Referring to an example of a digital copier employing the above-mentioned image-forming method, which is shown in FIG. 3, the image-forming method and apparatus, and a preferred embodiment thereof according to the present invention are described. However, the present invention is not limited to the example.

In regard to the apparatus of FIG. 3, in an image-reading section 30, light reflected from an original, exposed with light from a light source, undergoes color separation and is focused employing a CCD. Light information received by the CCD is converted to electrical signals and the resulting image data are transmitted to the image-writing section.

On the other hand, a photoreceptor drum 14, used for performing image-formation is uniformly charged with corona discharging employing a charging unit 15 and image exposure light is then irradiated onto the photoreceptor drum 14 from the laser beam source 11 in the image-writing section. Thereafter, reversal development is carried out in a development unit 16 to form a toner image on the exposed parts. In the case of the color image-forming apparatus as shown in the example, for each separated color which is formed by color separation during reading of an image, writing the image by charging and laser exposure are performed and color development is carried out for the corresponding color toner. This process is repeated and 4 color toner images of yellow, magenta, cyan, and black are superimposed on the photoreceptor.

Four color toner images are simultaneously transferred to a recording sheet employing the transfer electrode 17. The recording sheet is separated from the photoreceptor drum employing the separation electrode 19 and is fixed in the fixing device 20. On the other hand, the photoreceptor drum is cleaned by the cleaning device 21.

The four color toner images are described above. However, in some cases, other plurality of color images such as two-color images may be formed.

Furthermore, a toner image-forming method and a transfer method to a recording material may be different from those mentioned above.

Furthermore, other than those mentioned above, image information is stored in image memory means such as ROM, floppy disk, etc. and when required, the image information in the image memory is retrieved and can be output to the image-forming section. Accordingly, the present invention includes a device in which without having an image reading section, information from a computer, etc. is stored in a memory and is output to an image-forming section. The most popular devices of this type are LED printers and LBPs (laser beam printers).

EXAMPLES

The present invention is described with reference to Examples.

Example 1

Ten cylindrical supports composed of aluminum alloy underwent a cleaning process. The cleaning was carried out employing the process shown in FIG. 1(*b*). As the a cleaning liquid in a tank 1-1, a cleaning agent liquid 1 was employed. As a cleaning liquid in each of tanks 2-1, 2-2, and 2-3, deionized water was employed. The temperature of the cleaning liquid in the tank 1-1 was between 45 and 55° C. and the temperature of the cleaning liquid in each of the tanks 2-1, 2-2, and 2-3 was between 25 and 30° C. Dipping time in each tank was 30 seconds, and conveyance time between the tanks 1-1 and 2-1 was 1.5 minutes. After cleaning, the support was dried at 100° C. for 10 minutes and was then left to cool to the ambient temperature. One of the supports underwent the ESCA measurement and resulted in Δ[Si/Al]=0.441 and Δ[Na/Al]=0.135. After cooling, the rest of the supports were subjected to formation of a photosensitive layer.

Furthermore, after forming the photosensitive layer, the layer was peeled off employing a solvent, and the resulting support was subjected to ESCA measurement in the same manner and resulted in Δ[Si/Al]=0.433, Δ[Na/Al]=0.129, which were almost the same as those of the support after cleaning.

Wherein Δ[Si/Al] and Δ[Na/Al] are values defined as follows.

$$[Si(surf)/Als-Si(bulk)/Alb]=\Delta[Si/Al]$$

$$[Na(surf)/Als-Na(bulk)/Alb]=\Delta[Na/Al]$$

Si(surf): ESCA measurement (silicon) of a support surface after cleaning

Na(surf): ESCA measurement (sodium) of a support surface after cleaning

Si(bulk): ESCA measurement (silicon) of a support bulk

Na(bulk): ESCA measurement (sodium) of a support bulk

Als: ESCA measurement (support surface after cleaning) of a major element constituting a support Alb: ESCA measurement (support bulk)) of a major element constituting a support

Example 2

Ten cylindrical supports composed of an aluminum alloy underwent a cleaning process. The cleaning was carried out employing the process shown in FIG. 1(*c*). As a cleaning liquid in each of tanks 1-1 and 1-2, a cleaning agent liquid 2 was employed. As a cleaning liquid in each of tanks 2-1, 2-2, and 2-3, deionized water was employed. The temperature of the cleaning liquid in each of tanks 1-1 and 1-2 was between 25 and 30° C.; the temperature of cleaning liquid in each of the tanks 2-1 and 2-2 were between 25 and 30° C. described above, respectively and the temperatures of the cleaning liquid in the tank 2-3 was between 40 and 50° C. Dipping time in each tank was 2 minutes and conveyance time between tanks 1-1 and 2-1 was 1 minute. After cleaning, the support was dried at 50° C. for 7 minutes and was then left to cool to the ambient temperature. One of the supports underwent ESCA measurement and resulted in Δ[Si/Al]=0.082 and Δ[Na/Al]=0.077. After being left to cool, the rest of the supports were subjected to formation of a photosensitive layer.

Example 3

Ten cylindrical supports composed of an aluminum alloy underwent a cleaning process. The cleaning was carried out employing the process shown in FIG. 1(*d*). As a cleaning liquid in tank 1-1, a cleaning agent liquid 3 was employed. As a cleaning liquid in each of tanks 2-1, 2-2, 2-3, and 2-4, deionized water was employed. The temperature of the cleaning liquid in tank 1-1 was between 25 and 30° C.; the temperature of the cleaning liquid in each of tanks 2-1, 2-2, and 2-3 was between 25 and 30° C., and the temperature of the cleaning liquid in tank 2-4 was between 35 and 40° C. Dipping time to each tank was 3 minutes and conveyance time between tanks 1-1 and 2-1 was 2.5 minutes. After cleaning, the support was dried at 100° C. for 7 minutes and was then left to cool to the ambient temperature. One of supports underwent ESCA measurement and resulted in Δ[Si/Al]=0.079 and Δ[Na/Al]=0.094. After cooling, the rest of the supports were subjected to formation of a photosensitive layer.

Example 4

Ten cylindrical supports composed of an aluminum alloy underwent a cleaning process. The cleaning was carried out employing the process shown in FIG. 1(*e*). As a cleaning liquid in each of tanks 1-1 and 1-2, a cleaning agent liquid 4 was employed. As a cleaning liquid in each of tanks 2-1, 2-2, 2-3, 2-4, and 2-5, deionized water was employed. The temperature of the cleaning liquid in each of tanks 1-1 and 1-2 was between 35 and 45° C.; the temperature of the cleaning liquid in each of tank 2-1, 2-2, 2-3, 2-4, and 2-5 was between 30 and 40° C.

Dipping time in each tank was 20 seconds and conveyance time between tanks 1-1 and 2-1 was 5 minutes. After cleaning, the support was dried at 100° C. for 5 minutes and was then left to cool to the ambient temperature. One of the supports underwent ESCA measurement and resulted in Δ[Si/Al]=0.324 and Δ[Na/Al]=0.015. After cooling, the rest of the supports were subjected to formation of a photosensitive layer.

Example 5

Ten cylindrical supports composed of an aluminum alloy underwent a cleaning process. The cleaning was carried out employing the process shown in FIG. 1(*f*). As a cleaning liquid in each of tanks 1-1, 1-2, and 1-3, a cleaning agent liquid 5 was employed. As a cleaning liquid in each of thanks 2-1, 2-2, 2-3, 2-4, and 2-5, deionized water was employed. The temperature of the cleaning liquid in tank 1-1 was between 35 and 45° C.; the temperature of the cleaning liquid in each of tanks 1-2, 1-3, 2-1, 2-2, 2-3, and 2-4 was between 30 and 35° C., and the temperature of the cleaning liquid in tank 2-5 were between 40 and 50° C. Dipping time to each tank was 45 seconds and conveyance time between tanks 1-3 and 2-1 was 3 minutes. After cleaning, the support was dried at 60° C. for 10 minutes and was then left to cool to the ambient temperature. One of the supports underwent ESCA measurement and resulted in Δ[Si/Al]=0.101 and Δ[Na/Al]=0.045. After cooling, the rest of the supports were subjected to formation of a photosensitive layer.

Comparative Example 1

Ten cylindrical supports composed of an aluminum alloy underwent a cleaning process. The cleaning was carried out employing the process shown in FIG. 1(*a*). As the a cleaning liquid in a tank 1-1, a cleaning agent liquid 6 was employed. As a cleaning liquid in each of thanks 2-1 and 2-2, deionized water was employed. The temperature of the cleaning liquid in tank 1-1 was between 40 and 45° C. and the temperature of the cleaning liquid in each of tanks 2-1 and 2-2 were between 25 and 30° C. Dipping time to each tank was 1 minute, and conveyance time between tanks 1-1 and 2-1 was 7 minutes. After cleaning, the support was dried at 100° C. for 10 minutes and was then left to cool to the ambient temperature. One of the supports underwent ESCA measurement and resulted in Δ[Si/Al]=0.633 and Δ[Na/Al]=0.188. After cooling, the rest of the supports were subjected to formation of a photosensitive layer.

Comparative Example 2

Ten cylindrical supports composed of an aluminum alloy underwent a cleaning process. The cleaning was carried out employing the process shown in FIG. 1(*a*). As a cleaning liquid in tank 1-1, a cleaning agent liquid 7 was employed. As a cleaning liquid in each of tanks 2-1 and 2-2, deionized water was employed. The temperature of the cleaning liquid in tank 1-1 were between 40 and 45° C. and the temperature of the cleaning liquid in each of tanks 2-1 and 2-2 was between 25and 30° C. Dipping time to tank 1-1 was 2 minutes and to tanks 2-1 and 2-2 was 30 seconds, and conveyance time between tanks 1-1 and 2-1 was 10 minutes. After cleaning, the support was dried at 100° C. for 10 minutes and was then left to cool to the ambient temperature. One of the supports underwent ESCA measurement and resulted in Δ[Si/Al]=0.822 and Δ[Na/Al]=0.310. After being left to cool, the rest of the supports were subjected to formation of a photosensitive layer.

Further, ESCA is measured in the following way: an element ratio is calculated from the element peak area intensities of silicon (Si): Si 2p, sodium (Na): Na KLL, and aluminum (Al): Al 2p measured with a Shimadzu X-ray Photoelectron Analyzer (ESCA-1000, a product of Shimadzu Seisasusho: Mgka tube) at an X-ray output of 10 kV and 30 mA.

Further, the composition of each cleaning liquid is described below. Each cleaning agent was employed as a 2% aqueous solution. The described pH is that of the working solution.

TABLE 1

| | Cleaning Agent Liquid No. | | | | | | |
|---|---|---|---|---|---|---|---|
| Compound and pH | 1 | 2 | 3 | 4 | 5 | 6 | 7 |
| Nonionic Surface Active Agent | | | | | | | |
| Alkylpolyoxyethylene ether type (HLB 10) | 29 | | 52 | | | 43 | 28 |
| Pruronic type (HLB 12) | | 28 | | 30 | 31 | | |
| Anionic Surface Active Agent | | | | | | | |
| Sodium alkylsufonate | | 13 | 8 | 20 | | 27 | 20 |
| Sodium alkylbenzenesulfonate | 16 | | | | 28 | | |
| Amphoteric Surface Active Agent | | | | | | | |
| Alkylcarboxybetaine (A) | | 5 | | 4 | | | |
| Alkylsulfobetaine (B) | | | 10 | | | | 3 |
| Sodium alkylaminopropionate (C) | 15 | | | | 14 | 13 | |
| Inorganic Builder | | | | | | | |
| Sodium metasilicate | 6 | 13 | 10 | 13 | 20 | 11 | 16 |
| Other Additives | | | | | | | |
| Sodium gluconate | | 26 | | 20 | | | 20 |
| Sodium citrate | 23 | | | | 7 | 3 | |
| Sodium p-ethylbenzenesulfonate | 5 | 5 | | 4 | | | 4 |
| Sodium xylene-sulfonate | 6 | 10 | 20 | 9 | | | 9 |
| pH | 11.3 | 12.3 | 11.9 | 12.0 | 13.0 | 12.0 | 12.7 |

Further, upon coating a photosensitive layer, firstly, a subbing layer is coated on a photoreceptor support, and a charge generating layer and a charge transport layer were coated in this order. The composition of each layer liquid is as follows.

(Subbing Layer)

| | |
|---|---|
| Ethylene-vinyl acetate-methacrylic acid copolymer (ELVAX 4260, manufactured by Mitsui du Pont Chemical Co.) | 50 g |
| Toluene | 1770 ml |
| Methyl ethyl ketone | 180 ml |

The coating composition consisting of the compounds above was coated on a photoreceptor support so as to form a dried layer thickness of 0.4 μm.

(Charge Generating Layer)

| | |
|---|---|
| t Type metal-free phthalocyanine pigment | 50 g |
| Silicone resin (KR-5240, manufactured by Shin-Etsu Kagaku Co.) | 50 g |
| Methyl ethyl ketone | 2,400 ml |

The above-mentioned composition was dispersed in a sand mill for two hours. The resulting liquid was dip-coated on the above-mentioned subbing layer at a thickness of 0.5 μm.

(Charge Transport Layer)

| | |
|---|---|
| Styryl series compound (EL-26 having a structure of Compound 2 described below) | 1,400 g |
| Polycarbonate (Z-200, manufactured by Mitsubishi Gas Kagaku Co.) | 2,300 g |
| Silicone oil (KF-54, manufactured by Shin-Etsu Kagaku Co.) | 0.5 g |
| IRGANOX 1010 (manufactured by Ciba-Geigy Co.) | 70 g |

A mixture consisting of the compounds above was dissolved in 10,000 ml of 1,2-dichloroethane and the resulting solution was dip-coated on the above-mentioned charge generating layer, followed by drying at 90° C. for 60 minutes to form a charge transport layer having an average thickness of 20 $\mu$m.

(EL-26)

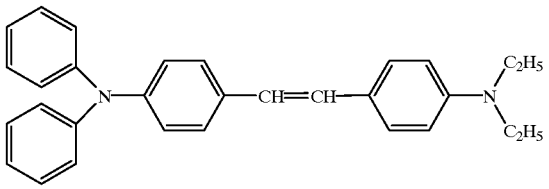

Performance Evaluation

A Practical Image-forming Test

The photoreceptor drum according to the present invention was installed in a Konica 9028 (manufactured by Konica Corp., a copying machine employing a semiconductor laser as a light source, a photoreceptor utilizing an organic photoconductor, and reversal development). After running 5,000 image-forming copies, image background density increase and unevenness of image density (visually observed in terms of black spots, presence of unevenness of intermediate image density) were evaluated.

(Image Background Density)

The density of a white part was measured by a reflection densitometer (improved PDA-65 manufactured by Konica Corp.)

A: density is not measurable

B: density is not more than 0.002 and exhibits no problems for commercial use

C: density is 0.002 or more and is marginally acceptable for commercial use

D: density is 0.05 or more and is definitely not acceptable for commercial use (Unevenness of Image Density)

A: neither black spots nor unevenness of intermediate image density is observed

B: black spots and unevenness of intermediate image density are negligible and exhibits no problem for commercial use C: black spots and unevenness of intermediate image density are observed at a level to cause problems for commercial use D: definite problems for commercial use B Electric Potential Stability Instead of the development device in Konica 9028, a potentiometer was installed and electric potential of the photoreceptor was measured at low temperature and low humidity (10° C. and 20% RH).

The difference between charged electric potentials of unexposed parts of the initial image and after running 5,000 copies was obtained as described below.

Electric Potential Stability={(initial VH)−(VH after running 5,000 copies)}/(initial VH)×100

A: not more than 5% and absolutely no problem for commercial use

B: not more than 10% and no problem for commercial use

C: not less than 10% and not more than 15%, and problems exist for commercial use D: not less than 15% and definite problems exist for commercial use The results are shown in Table 2 below.

TABLE 2

| | Conveyance Time Between Tanks | Si/Al | Na/Al | Image Background Density | Unevenness of Image Density | Electric Potential Stability |
|---|---|---|---|---|---|---|
| Example 1 | 1.5 minutes | 0.441 | 0.135 | B | B | B |
| Example 1b | — | 0.433 | 0.129 | — | — | — |
| Example 2 | 1 minute | 0.082 | 0.077 | A | A | A |
| Example 3 | 2.5 minutes | 0.079 | 0.094 | A | A | A |
| Example 4 | 5 minutes | 0.324 | 0.015 | B | B | B |
| Example 5 | 3 minutes | 0.101 | 0.045 | A | A | A |
| Comparative Example 1 | 7 minutes | 0.633 | 0.188 | D | C | D |
| Comparative Example 2 | 10 minutes | 0.822 | 0.310 | D | D | D |

1b: ESCA measurement after peeling off of the photosensitive layer

As can clearly be seen in Table 2, Examples 1 to 5 according to the present invention exhibit excellent properties regarding both practical image-forming tests (image background density and unevenness of image density) and electric potential stability. However, Comparative Examples 1 and 2 are found to be not suitable for commercial use.

The present invention, can provide a cleaning method of an electrophotographic photoreceptor which causes no defects such as background density, black spots or white spots; causes no pollutants and is readily handled, a production method of a photoreceptor and an electrophotographic photoreceptor using the same, and an image-forming apparatus using the same.

We claim:

1. A method of preparation of an electrophotographic photoreceptor comprising cleaning a support by applying a cleaning agent to a surface of said support and providing a photosensitive layer on the surface of the cleaned support, said cleaning agent including an aqueous liquid containing a surface active agent comprising Si and Na and having a pH of 9.5 to 13.0, an amount of said Si and said Na remaining on said surface which, when evaluated in terms of ESCA, satisfies the following relationship with respect to aluminum or nickel constituting a major element of said support;

$$0<[Si(surf)/Xs-Si(bulk)/Xb]\leqq 0.5$$

$$0<[Na(surf)/Xs-Na(bulk)/Xb]\leqq 0.3,$$

wherein

Si(surf): ESCA measurement of silicon of said support surface after said cleaning Na(surf): ESCA measurement of sodium of said support surface after said cleaning Si(bulk): ESCA measurement of silicon of support bulk Na(bulk): ESCA measurement of sodium of said support bulk Xs: ESCA measurement of nickel or aluminum of said support surface after said cleaning of said support surface Xb: ESCA measurement of nickel or aluminum of said support bulk.

2. A method of preparation of the electrophotographic photoreceptor of claim 1, wherein the aqueous surface active agent comprises an inorganic builder containing Si.

3. A method of preparation of the electrophotographic photoreceptor of claim 2, wherein the inorganic builder is sodium orthosilicate or sodium metasilicate.

4. A method of preparation of the electrophotographic photoreceptor of claim 3, wherein the inorganic builder is sodium metasilicate.

5. The method of claim 1 wherein said pH is 10.5 to 12.5.

* * * * *